United States Patent [19]

Felix

[11] 4,038,723

[45] Aug. 2, 1977

[54] METHOD OF AND AN ARRANGEMENT FOR STANDARDIZING COMBER SLIVERS

[75] Inventor: Ernst Felix, Uster, Switzerland

[73] Assignee: Zellweger, Ltd., Switzerland

[21] Appl. No.: 544,684

[22] Filed: Jan. 28, 1975

[30] Foreign Application Priority Data

Feb. 28, 1974 Switzerland ..... 2868/74

[51] Int. Cl.[2] ..... D01G 19/00; D01H 5/38

[52] U.S. Cl. ..... 19/215; 19/240

[58] Field of Search ..... 19/239, 240, 241, 243, 19/115, 215

[56] References Cited

U.S. PATENT DOCUMENTS

| | | | |
|---|---|---|---|
| 2,950,508 | 8/1960 | Locher | 19/240 |
| 2,964,803 | 12/1960 | Robinson | 19/240 |
| 2,981,986 | 5/1961 | Neil | 19/240 |
| 3,105,997 | 10/1963 | Mackie | 19/243 |
| 3,958,305 | 5/1976 | Felix et al. | 19/240 |

OTHER PUBLICATIONS

German Published Application, 2,347,956, Felix et al., 5-1974.

*Primary Examiner*—Dorsey Newton
*Attorney, Agent, or Firm*—Craig & Antonelli

[57] ABSTRACT

A plurality of combing machine slivers having periodically variable densities are combined in such a way that the density variations approximately compensate one another and a complete sliver having little density variation is formed. The relative phase positions of the respective combing machine slivers when assembled together are controlled in response to the periodicity of the complete sliver.

7 Claims, 4 Drawing Figures

FIG. 1
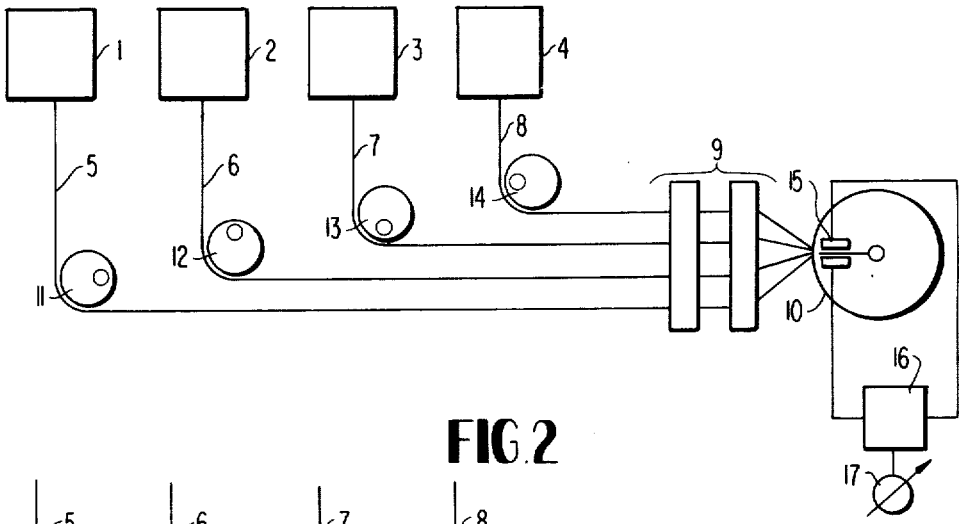
FIG. 2
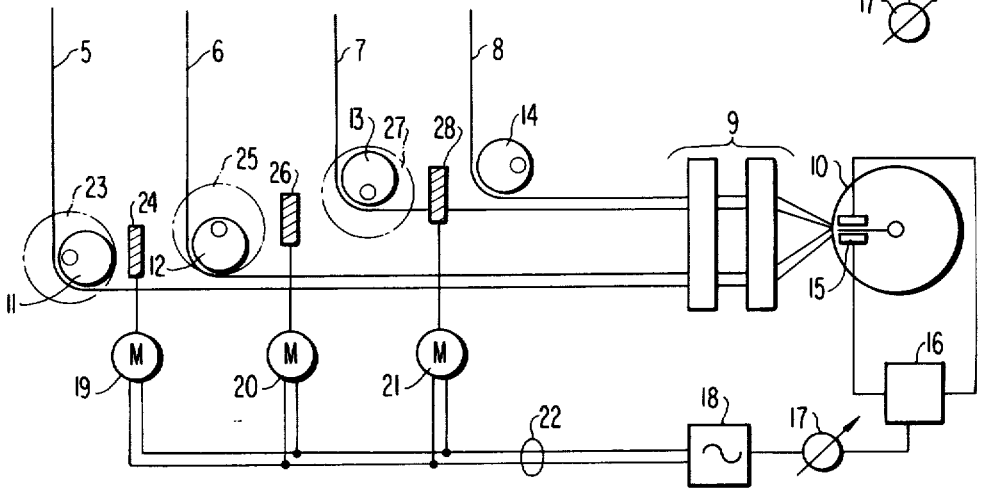
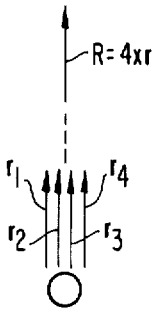
FIG. 3
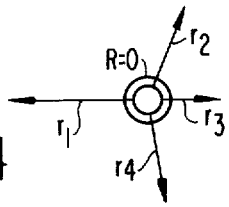
FIG. 4

METHOD OF AND AN ARRANGEMENT FOR STANDARDIZING COMBER SLIVERS

U.S. Pat. No. 3,958,305 relates to a method for eliminating or equalizing the combing periods in combing machine slivers in which the phase position of the combing periods of the individual combing machine outputs (i.e., the combing machine slivers) is regulated and/or controlled in such a way that they at least approximately compensate one another. By "combing periods"is meant periodic fluctuations in sliver density which occur, for example, in cotton spinning processes and the like.

The corresponding apparatus for carrying out the method described in the above-referenced patent comprises means for determining the phase position of the combing periods of the individual combing machine outputs, and means for varying the phase position of the combing periods in dependence upon a control signal.

In the exemplary embodiment described in the above-referenced patent, the phase position of the combing periods of each individual combing machine output is determined by means of a sensor, the signals from these sensors being converted into control commands which modify the respective phase positions of the combing machine slivers until they cancel one another out. This arrangement requires a number of sensors corresponding to the number of combing machine outputs, which in some cases requires a very complicated, expensive arrangement.

The present invention improves this method for eliminating or equalizing combing periods in combing machine slivers, in which the phase position of the combing periods of the individual combing machine outputs is regulated and/or controlled in such a way that they at least approximately compensate one another, and is distinguished by the fact that the effect of compensating the combing periods is determined on the basis of the periodicity (i.e., the periodic variation in density) of the resulting complete sliver. In other words, the periodic fluctuations in density (or periodicity) of the completed sliver is used as the control parameter rather than the periodicity of the individual combing machine output slivers.

The invention also relates to an apparatus for carrying out this method comprising means for modifying the phase position of the combing periods in dependence upon a control signal, and is distinguished by the fact that the control signal for modifying the phase position of the combing periods is derived from the magnitude and phase position of the residual periodicity of the total output, i.e., the complete sliver. In other words, the control signal for modifying the phase position of the combining periods is derived from the periodic character of the density fluctuations in the completed sliver.

Thus, the present invention provides a process for compensating the combining periods of combing machine slivers which comprises combining a plurality of combing machine slivers together to form a complete sliver, measuring the density of the complete sliver, and adjusting in response to the periodicity of the complete sliver the relative phase positions of the respective combing machine slivers so that the combing periods of the respective combing slivers approximately compensate one another.

In addition, the present invention further provides an apparatus for compensating the combining periods in combing machine slivers comprising means for combining a plurality of combing machine slivers to form a complete sliver, measuring means for measuring the magnitude and phase position of the density variations in said complete sliver, and means responsive to said measuring means for varying the phase positions of the respective combing machine slivers so that the combing periods of the respective combing slivers approximately compensate one another.

The present invention is based on the recognition that, ultimately, it is only the quality of the total output in which several combing machine slivers are combined with one another that is important, the way in which this quality is obtained being of secondary importance. For this reason, it is sufficient to determine the residual periodicity of the sliver as a whole and to reduce this residual periodicity to a minimum by modifying the phase position of the individual outputs, i.e., the individual combing machine slivers.

The method as a whole is essentially an empirical method in that the phase positions of the individual outputs are modified until and in such a direction that the residual periodicity of the total output reaches a minimum. Basically, this empirical method is laborious. However, since the changes is phase take place slowly in the combing machine itself, a certain amount of time can be set aside in which to make these tests.

However, it is also possible for the variation in the phase position of each individual output to pass through controlled, predetermined programs, i.e., for the combing periods to wobble. The wobble frequencies of the individual outputs must differ from one another. Observation of the residual periodicity of the total output will show that a certain, related phase position of the individual outputs produces a minimum, while all other combinations of the individual phase positions produce greater residual periodicities.

The means for adjusting the phase position then have to be held in that position which produces a minimum of residual periodicity in the complete sliver.

Further monitoring of the residual periodicity then only has to confirm that the minimum value reached is being maintained. In the event of appreciable and permanent changes, the combing periods have to be wobbled again in order once again to find the minimum residual periodicity.

BRIEF DESCRIPTION OF THE DRAWINGS

One embodiment of the invention is described by way of example in the following with reference to the accompanying drawings, wherein:

FIG. 1 is a schematic diagram illustrating a combing machine producing four outputs, i.e., four combing machine slivers.

FIG. 2 is a schematic diagram illustrating an automatic wobble control system.

FIG. 3 shows a first vector diagram.

FIG. 4 shows another vector diagram explaining wobbling of the phase positions.

DETAILED DESCRIPTION

FIG. 1 diagrammatically illustrates a combing machine or comber with four comber heads 1, 2, 3 and 4. The slivers 5, 6, 7 and 8 issuing from the individual comber heads are deflected through approximately 90°, stretched together in a drawing system 9 following the comber and, finally, deposited into a can 10. The periodicity of the complete sliver is determined by means of a sensor 15. This sensor 15 may be, for example, a capacitive or an active-pneumatic sensor. The signal from the sensor is converted in an evaluation stage 16 and indicated for example in an instrument 17.

Fourier analyzers are particularly suitable for evaluating this signal. Since the basic frequency of the periodicity of the complete sliver is directly coupled with the frequency of the combing period, it is of advantage for the analyzing frequency to be controlled by the comber. This affords the further advantage of an arbitrarily narrow band width for the frequency band to be investigated and, hence, a further reduction in interfering frequencies. The object of this evaluation is to obtain a minimum of the output signal from the analyzer.

Specific examples of embodiments useful as evaluation stage 16 are described in U.S. Pat. No. 2,516,768, Re. 23,368 and 2,679,639. This latter patent describes a so-called "integrator " which is an analog computer and would serve in the present invention to average the electrical signal corresponding to the variable cross-section of the sliver determined by sensor 15.

FIG. 1 shows the guides around which the individual outputs are guided in the form of round pins 11, 12, 13 and 14. In one exemplary embodiment of the aforementioned U.S. Pat No. 3,958,305 and as shown in present FIG. 1, the phase position of each individual output or combing machine sliver is changed by arranging the guide pins eccentrically and arranging them for rotation about these eccentric axes.

Basically, the result expressed by the deflection of the indicating instrument in accordance with the present invention does not give any indication as to the origin of the residual periodicity. However, this can be changed for example by empirically turning one guide pin after the other and observing the effect upon the magnitude of the residual periodicity. If it increases, the same guide pin is turned in the other direction. If it falls, the further tests are conducted with the pin in this new position This procedure can be repeated with each individual combing machine sliver until the residual periodicity cannot be reduced any further.

However, this basically complicated empirical approach to the optimum value can also be automated by the technique known among experts as wobbling.

FIG. 2 shows a system for wobbling the phase positions of the individual outputs in combination with a system for automatically regulating phase position. To this end, the eccentric guide pins 11, 12 and 13 are connected through gears 23, 24; 25, 26 and 27, 28 to drive systems, for example in the form of motors 19, 20 and 21, so that the eccentric pins rotate at a certain rotational speed as long as voltage is applied to the line 22 by switchgear 18.

One of the eccentric guide pins 14 has to remain undriven, because one combing machine sliver can be regarded as a referencephase sliver.

The gears 23, 24; 25, 26 and 27, 28, which are shown in the form of worm gears, are arranged in such a way that their rotational speeds are different. However, it is of advantage to select simple rotational speed ratios in order to obtain identical patterns or arrangements of the eccentric guide pins within reasonable time intervals.

The instrument 17 may be in the form of, for example, a contact instrument which closes a switching contact on reaching a certain minimum position. This switching contact acts on the switchgear 18 which keeps the drive systems 19, 20 and 21 under voltage until the instrument 17 has reached its minimum pos'tion. If, during production, the residual periodicity increases systematically to such an extent that the minimum contact of the instrument 17 is opened, the eccentric guide pins 11, 12 and 13 begin to rotate again until the minimum value is reached once again. Thus it will be appreciated that instrument 17 serves as a means for stopping the adjustment action provided by gears 23 to 28.

FIGS. 3 and 4 explain the effect of the eccentric guide pins rotating at different rotational speeds in the form of vector diagrams. In FIG. 3, all the vectors $r_1$, $r_2$, $r_3$ and $r_4$ are in phase, and the length of the resulting vector R is four times the length of an individual vector.

FIG. 4 shows the moment at which all four vectors (three of which rotate at different speeds from the starting position shown in FIG. 3) are in 90°, 180° and 270° phase displacement. The resulting vector R is O. Naturally, the lengths of the quantities symbolized by the vectors $r_1$, $r_2$, $r_3$ and $r_4$ show differences, in the same way as the respective phase positions cannot amount exactly to 90°. However, it is possible in this case, too, to determine a residual vector which corresponds to the residual periodicity which forms a minimum around a value 0, providing enough time is allowed for finding the optimum positions of the eccentric guide pin.

Although only a few embodiments of the present invention have been described above, it should be appreciated that many modifications can be made without departing from the spirit and scope of the invention. All reasonable modifications which are not specifically set forth are intended to be included within the scope of the present invention which is to be limited only by the following claims.

What is claimed is:

1. Apparatus for reducing the periodicity of a complete sliver formed by combining a plurality of combing machine slivers, each of said combing machine slivers exhibiting a periodicity, said apparatus comprising means for combining a plurality of combing machine slivers to form a complete sliver, measuring means for measuring the magnitude and phase position of the density variations in said complete sliver, and adjusting means responsive to said measuring means for simultaneously and continuously varying the phase positions of the respective combing machine slivers at respectively different rates until the combing periods of the respective combing slivers approximately compensate one another.

2. The apparatus as defined in claim 1, wherein said measuring means includes means for measuring the density of said complete sliver, averaging means for averaging the measured density of said complete sliver, and comparing means for comparing said average density to a reference value representing minimum density.

3. The apparatus as defined in claim 2, wherein said adjusting means includes first means for individually varying the phase positions of the respective combing machine slivers and second means responsive to said average density exceeding said reference value for actuating said first means.

4. A process for reducing the periodic fluctuation in the density of a complete sliver formed by combining a plurality of combing machine slivers each exhibiting density fluctuation periods having relative phase positions with respect to one another, comprising the steps of measuring the density of the complete sliver to determine the density variations thereof;

comparing the measured density of the complete sliver to a reference value representing a desired density value; and wobbling the phase positions of the individual combing machine slivers when the measured density is greater than said reference value by simultaneously and continuously varying the phase positions of the respective combing machine slivers until the periodicities of the respective combing machine slivers approximately compensate one another and thereby reduce said measured density to said reference value.

5. The process of claim 4, wherein said wobbling step is accomplished by continuously modifying the phase positions of a plurality of the respective combing machine slivers at different rates.

6. The process of claim 5, wherein one of said combing machine slivers is considered a reference sliver, the phase positions of the other combing machine slivers being adjusted with respect to the phase position of said reference sliver.

7. The process of claim 4, wherein said step of measuring the density of the complete sliver includes averaging the value of measured density over a period of time, and said comparing step comprises comparing the average density of said complete sliver to said reference value.

* * * * *